US008516618B2

(12) United States Patent
Adams et al.

(10) Patent No.: US 8,516,618 B2
(45) Date of Patent: Aug. 27, 2013

(54) CAP WITH ADJUSTABLE VISOR

(75) Inventors: Richard B. Adams, Carlsbad, CA (US); Fong-Min Chang, Diamond Bar, CA (US)

(73) Assignee: Otto International, Inc., Fairburn, GA (US)

( * ) Notice: Subject to any disclaimer, the term of this patent is extended or adjusted under 35 U.S.C. 154(b) by 148 days.

(21) Appl. No.: 12/887,417

(22) Filed: Sep. 21, 2010

(65) Prior Publication Data

US 2012/0066814 A1 Mar. 22, 2012

(51) Int. Cl.
*A42B 1/00* (2006.01)
*A42B 1/02* (2006.01)

(52) U.S. Cl.
USPC ..... 2/195.1; 2/175.1; 2/195.6

(58) Field of Classification Search
USPC ..... 2/175.4, 175.5, 195.1, 195.2, 195.5, 2/195.6, 195.7, 200.1, 200.3, 175.1, 209.12
See application file for complete search history.

(56) References Cited

U.S. PATENT DOCUMENTS

| | | | | |
|---|---|---|---|---|
| 4,777,667 | A | 10/1988 | Patterson et al. | |
| 4,951,319 | A | 8/1990 | Phillips, Jr. et al. | |
| D360,972 | S * | 8/1995 | Bennett, Jr. | D2/865 |
| 5,669,071 | A | 9/1997 | Vu | |
| 5,884,334 | A * | 3/1999 | Collette et al. | 2/195.1 |
| 6,088,837 | A * | 7/2000 | Baker | 2/195.1 |
| 6,237,156 | B1 | 5/2001 | Ellman et al. | |
| 6,557,180 | B2 | 5/2003 | Hall McKenzie | |
| 6,662,371 | B2 | 12/2003 | Shin | |
| 7,069,599 | B2 | 7/2006 | Guerra | |
| 7,082,618 | B1 | 8/2006 | Muso | |
| 7,082,619 | B1 * | 8/2006 | Thompson | 2/175.5 |
| 2003/0041367 | A1 * | 3/2003 | Hadden et al. | 2/195.5 |
| 2003/0226193 | A1 * | 12/2003 | Wang | 2/195.6 |
| 2005/0223475 | A1 * | 10/2005 | Turner | 2/209.4 |
| 2006/0143793 | A1 * | 7/2006 | Liao | 2/195.6 |
| 2006/0143794 | A1 * | 7/2006 | Hou | 2/200.3 |

* cited by examiner

*Primary Examiner* — Shelley Self
*Assistant Examiner* — Jameson Collier
(74) *Attorney, Agent, or Firm* — Fox Rothschild LLP

(57) ABSTRACT

A headwear having a selectively adjustable visor is disclosed. The headwear includes a crown for covering at least a portion of a wearer's head. A visor is attached to the crown and includes a visor cover disposed over a unitary visor body. The visor body has a first surface and an opposing second surface to define a uniform thickness. The visor body is configured with at least one slit formed therein. The at least one slit defines a proximal portion and a distal portion. The distal portion is transitional relative to the proximal portion between a first position and a second position. The slit allows the distal portion of the visor to adjust relative to the proximal portion, thereby to enhancing the visor appearance of the headwear and providing a better shade to the wearer.

19 Claims, 4 Drawing Sheets

CAP WITH ADJUSTABLE VISOR

TECHNICAL FIELD

The present invention relates to the field of headwear, and more specifically to an improved construction of a headwear, such as a baseball cap, sun visor, or golf hat, having a slit visor, which allows the wearer to adjust the visor to various desired positions.

BACKGROUND OF THE INVENTION

The basic elements of a headwear, such as a baseball cap, include a crown and a visor or bill. The crown portion fits onto a wearer's head with the visor portion extending horizontally outward therefrom in order to prevent sunlight or other weather elements from distracting the wearer's vision.

Typical headwear may contain indicia of place names, corporation logos, sport teams and other decorative artwork as a way to enhance the overall appearance of the cap, visor, or hat. Such decorative designs are commonly applied on the crown portion of the headwear as opposed to the visor portion due to the visor portion's obscured location once worn on an individual. Furthermore, the visor of conventional headwear, such as a baseball cap, provides inadequate sunlight protection to the wearer as the shade over the wearer is limited by the length in which the visor extends from the crown.

Methods have been suggested to provide more flexibility to headwear visors due to their inadequate sunlight protection to the wearer and inability to reveal artwork when placed on the visor surfaces. These methods include detachable visor, add-on/removable apparatus, internal/external hinges with screws, or paired fingers with mating edges and prongs, which in general are items not found in conventional headwear, resulting in additional labor, increase in material cost, and altering overall headwear appearances.

In view of the above, there exists a need for a headwear with a slit visor that can still maintain the original appearance of the visor while providing safe and easy adjustment thereof. Such headwear permits the wearer to selectively adjust the visor to desired positions allowing the artwork to reveal as well as offering additional shade and protection to the wearer.

SUMMARY OF THE INVENTION

In a first aspect, there is provided herein a headwear having a selectively adjustable visor, the headwear including: a crown for covering at least a portion of a wearer's head; a visor attached to the crown, the visor having a visor cover disposed over a unitary visor body; the visor body having a first surface and an opposing second surface to define a uniform thickness; wherein the visor body is configured with at least one slit formed therein, the at least one slit defining a proximal portion and a distal portion, the distal portion being transitional relative to the proximal portion between a first position and a second position.

In certain embodiments, the visor cover is formed from at least one section of stretchable or non-stretchable material.

In certain embodiments, the at least one slit is curved, straight, zig-zag, or waved.

In certain embodiments, the at least one slit is a gap, a cut, or an aperture.

In certain embodiments, the visor body is fabricated of at least one of cardboard, metal, polymers, or a combination thereof.

In certain embodiments, the visor body includes a pair of connector portions where the proximal portion meets the distal portion, such that the distal portion may be integrally connected to the proximal portion by way of the connector portions.

In certain embodiments, the at least one slit terminates at a first slit end and an opposing second slit end.

In certain embodiments, the at least one slit may be laterally disposed while extending from a periphery of the visor body to a middle section of the visor body, thereby forming a connector portion at the first slit end and the second slit end.

In certain embodiments, the connector portion at the first slit end and the second slit end is medial to the laterally disposed slit.

In certain embodiments, the at least one slit and connector portion allow the distal portion to articulate relative to the proximal portion.

In certain embodiments, the at least one slit may extend at least partially from the first surface toward the second surface, which may facilitate bending of the distal portion about the second surface, or from the second surface toward the first surface, which may facilitate bending of the distal portion about the first surface.

In certain embodiments, the distal portion may be disposed in a planar position relative to the proximal portion such that the distal portion is substantially co-planar with the proximal portion.

In certain embodiments, the visor cover may include artwork displayed adjacent the distal portion, such that when the distal portion is disposed in the first or second position, the artwork is readily apparent.

In certain embodiments, the distal portion includes a distal most tip which is disposed down, or towards a second side of a plane defined by the proximal portion when the distal portion is disposed in the first position.

In certain embodiments, the distal most tip is disposed up, or towards a first side of the plane defined by the proximal portion when the distal portion is disposed in the second position.

In a second aspect, there is provided herein a headwear having a selectively adjustable visor, the headwear including: a crown for covering at least a portion of a wearer's head; a visor attached to the crown, the visor having a visor cover disposed over a unitary visor body; the visor body having a first surface and an opposing second surface to define a uniform thickness; wherein the visor body is configured with a plurality of slits extending around the visor body, the plurality of slits defining a proximal portion and a distal portion, the distal portion being transitional relative to the proximal portion between a first position and a second position.

In certain embodiments, the visor body may include a plurality of overlapping slits formed therein to allow for multiple angular dispositions of the visor.

In certain embodiments, the plurality of overlapping slits intersect a common axis.

In certain embodiments, the plurality of slits are curved, straight, zig-zag, or waved.

In a third aspect, there is provided herein a headwear having a selectively to adjustable visor, the headwear including: a crown for covering at least a portion of a wearer's head; a visor attached to the crown, the visor having a visor cover disposed over a visor body, the visor body being composed of a polymer having a first surface and an opposing second surface to define a uniform thickness; wherein the visor body includes a proximal portion and distal portion, the distal portion being defined by the first surface having a selectively adjustable angle, wherein the distal portion is transitional relative to the proximal portion in response to heat and pressure, followed by subsequent cooling of the polymer.

Various advantages of this invention will become apparent to those skilled in the art from the following detailed description of the various and preferred embodiments, when read in light of the accompanying drawings.

DETAILED DESCRIPTION OF THE INVENTION

Figure 1:
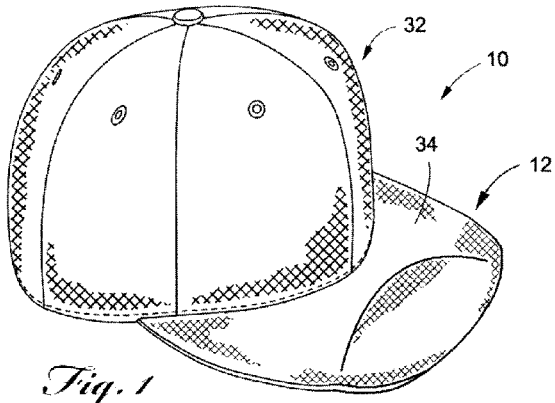
FIG. 1 is an upper perspective view of a cap, including a selectively adjustable visor.
Figure 2:
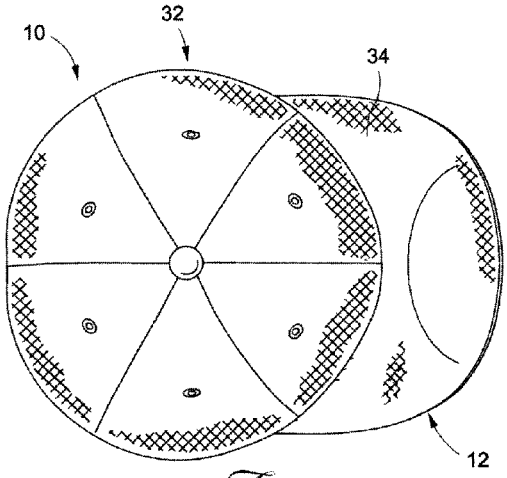
FIG. 2 is a top view of the cap depicted in FIG. 1.
Figure 3:
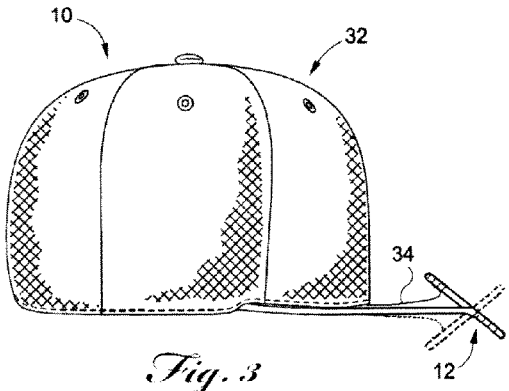
FIG. 3 is a side view of the cap depicted in FIGS. 1-2.
Figure 4:
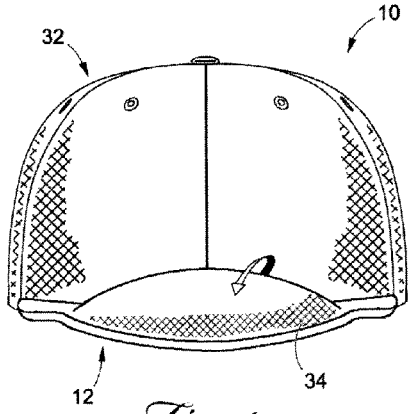
FIG. 4 is a front view of the cap depicted in FIGS. 1-3.
Figure 5:
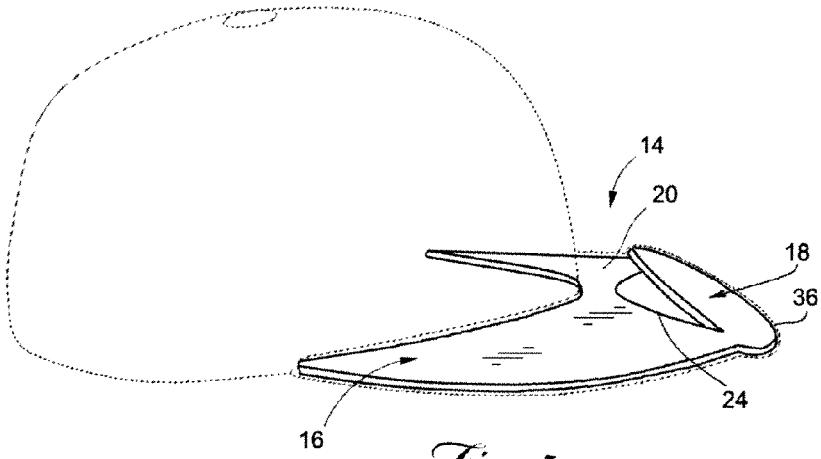
FIG. 5 is an upper perspective view of a visor body with a crown and visor cover shown in phantom.
Figure 6:
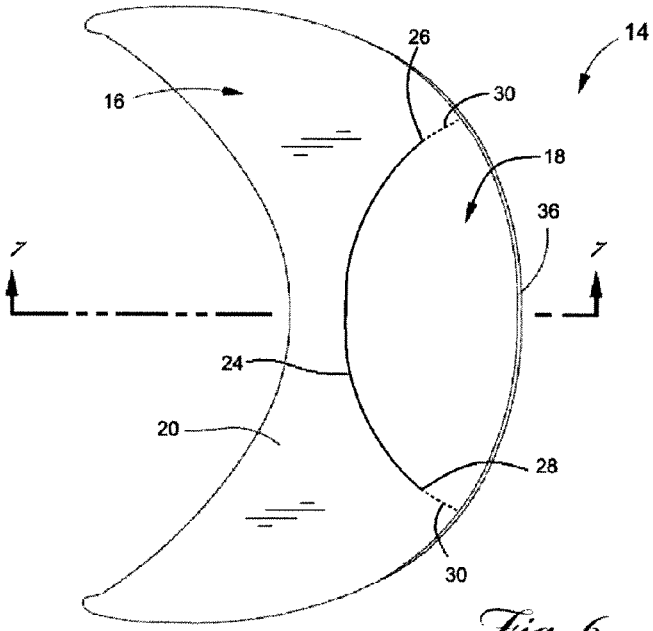
FIG. 6 is a top view of the visor body depicted in FIG. 5.
Figure 7:
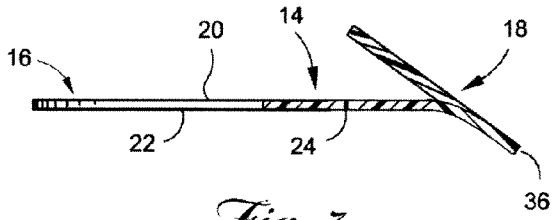
FIG. 7 is a side sectional view of the visor body depicted in FIGS. 5-6.

The detailed description set forth below in connection with the appended drawings is intended as a description of various and preferred embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Referring now to the drawings, specifically, FIGS. 1-4, there is depicted a cap 10 having a selectively adjustable visor 12. More specifically, the visor 12 includes a slit visor body 14 (FIGS. 5-9) having a proximal portion 16 (FIGS. 5-9) and distal portion(s) 18 (FIGS. 5-9) selectively moveable relative to the proximal portion 16. The distal portion 18 may be adjusted to modify the amount of shade provided by the visor 12 and/or to make apparent of the artwork (not shown) on visor cover 34.

Referring now specifically to FIGS. 5-9, there is depicted a unitary visor body 14 defining the proximal portion 16 and the distal portion(s) 18, preferably formed from a single piece of material. The visor body 14 includes a first (upper) surface 20 and an opposing second (lower) surface 22, preferably defining a uniform thickness, although it is understood that the visor body 14 may also define a non-uniform thickness. According to one embodiment, a slit 24 is formed within the visor body 14 and extends from the first surface 20 to the second surface 22. The slit 24 is formed to allow the distal portion 18 to articulate relative to the proximal portion 16 between a first position and a second position. The slit 24 terminates at a first slit end 26 and an opposing second slit end 28. In this regard, the slit 24 is contained within the visor body 14 and does not completely dissect the visor body 14 which would result in separate proximal and distal portions 16, 18. Accordingly, the visor body 14 includes a pair of connector portions 30 where the proximal portion 16 meets the distal portion 18. In this regard, the distal portion 18 may be integrally connected to the proximal portion 16 via the connector portions 30. The connector portions 30 may be flexible enough to allow the distal portion 18 to easily adjust up or down between the first and second positions.

Figure 10:
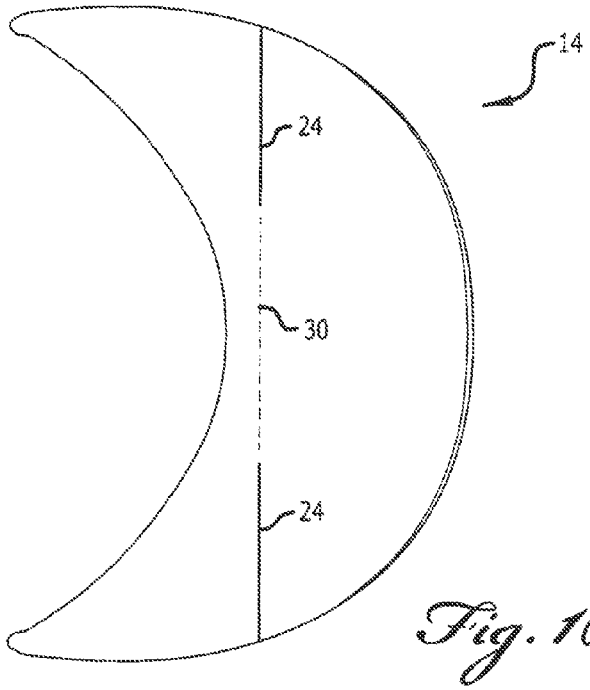
FIG. 10 is a top view of an alternative embodiment of the visor body.

In a variation of the invention, the slit(s) 24 may extend from the periphery of the visor body 14 into the middle of the visor body 14, which may result in a connector portion 30, which is medial to the laterally disposed slit(s) 24 (see FIG. 10). For instance, the visor body 14 may include a single medial connector portion 30 disposed between a pair of lateral slits 24 extending into the visor body 14 from the periphery of the visor body 14.

Figure 8:
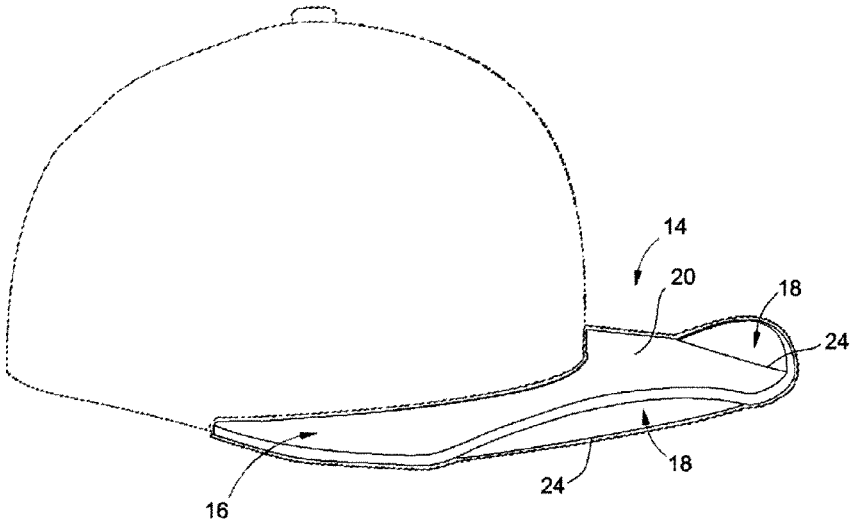
FIG. 8 is an upper perspective view of a visor body with a crown and visor cover depicted in phantom.
Figure 9:
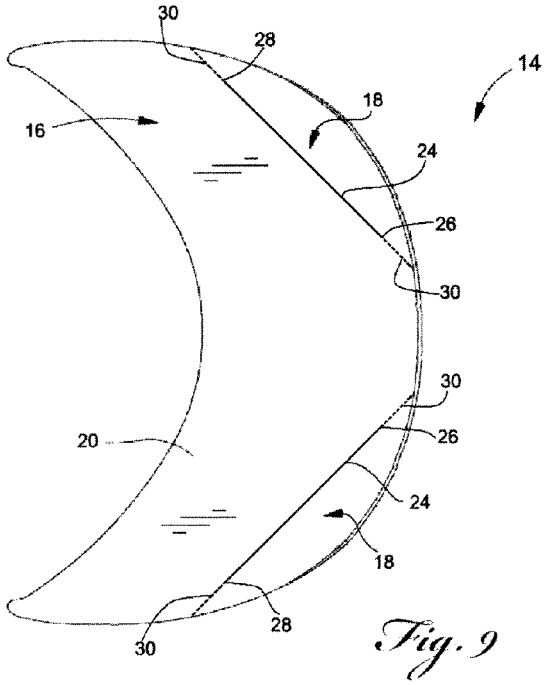
FIG. 9 is a top view of the visor body depicted in FIG. 8.

In another variation of the invention, a straight slit can terminate at slit ends 26 and 28 (see FIGS. 8 and 9). In this configuration, the slit 24 may only extend partially between the first surface 20 and the second surface 22. Along these lines, the slit 24 may extend partially from the first surface 20 toward the second surface 22 (which may facilitate bending of the distal portion 18 about the second surface 22), or from the second surface 22 toward the first surface 20 (which may facilitate bending of the distal portion 18 about the first surface 20).

It is further contemplated that as an alternative to, or in conjunction with, the slit 24 in the visor body 14, various polymer materials may be selected for visor body 14 to form fixed configurations of the distal portion 18 or to form curvature on first and second surfaces 20, 22 on the distal portion 18. For example, the polymer materials may include, but are not limited to, ABS plastic, polyurethane, polyester, or vinyl, or a combination thereof. In operation, before and/or after the visor cover 34 is disposed about the visor body 14, heat and pressure is applied to induce the polymer visor body 14 to soften and reshape into optimal configuration. Upon subsequent cooling, the polymer visor body 14 solidifies and retains the new shape.

The first and second surfaces 20, 22 extend across both the proximal portion 16 and the distal portion 18, such that when the distal portion 18 is disposed in the first position (see FIGS. 3, 4, 5 and 7), the distal most tip 36 is disposed down, or towards the second side of the plane defined by the proximal portion 16. When the distal portion 18 is disposed in the second position (as shown in phantom in FIG. 3), the distal most tip 36 is disposed up, or towards the first side of the plane defined by the proximal portion 16. It is contemplated that the distal portion 18 may additionally be disposed in a planar position relative to the proximal portion 16, wherein the distal portion 18 is substantially co-planar with the proximal portion 16.

The slit 24 and connector portion 30 allow the distal portion 18 to articulate is relative to the proximal portion 16 without requiring the use of a hinge or other pivoting members. In this regard, the visor body 14 may be safer and more aesthetically pleasing than a visor having a hinge connected thereto. More specifically, a hinged visor may present a risk of getting the wearer's hair caught in the hinge. Therefore, by providing a visor 12 which is moveable without a hinge, such a risk is mitigated. Furthermore, a hinge may detract from the overall appearance of the cap. Therefore, a slit visor may be seamlessly integrated into a conventional cap design without detracting from the overall appearance of the cap.

One embodiment of the visor 12 includes a visor cover 34 disposed about the visor body 14 and connected to a crown 32. The visor cover 34 may include a fabric, leather, plastic vinyl, or other materials known by those skilled in the art. The lack of hinges or other pivoting elements on the visor body 14 allows the visor cover 34 to be seamlessly disposed about the visor body 14 to enhance the aesthetic appeal of the cap 10. Furthermore, the lack of hinges or pivoting elements allows a needle on a conventional sewing machine to puncture/stitch/sew without any modification or need to avoid certain areas on the visor body 14 (such as hinges), which may break the needle.

The visor cover 34 may include one or more layers of stretchable or non-stretchable material and may contain various sections that are disposed adjacent to the first surface 20 and/or the second surface 22 of the visor body 14 to account for the movement of the distal portion 18 between the first position and the second position. The visor cover 34 may include designs or other artwork displayed adjacent the distal portion 18, such that when the distal portion 18 is disposed in the first or second position, the artwork becomes more readily apparent.

Figure 11:
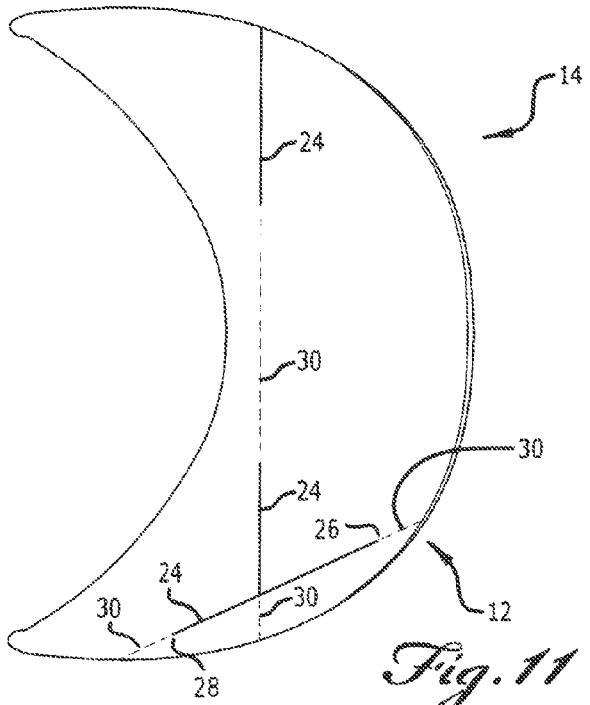
FIG. 11 is a top view of another alternative embodiment of the visor body.

As used herein, the term "cap" may refer to a conventional baseball cap, sun visor, golf hat or any other headwear known by those skilled in the art having a visor connected thereto. The visor 12 may extend from a portion of the crown 32, as depicted in FIGS. 1-4, or may completely circumnavigate the crown 32 (not shown). In this regard, the visor body 14 may include a plurality of slits 24 extending around the visor body 14. It is also contemplated that the visor body 14 may include a plurality of overlapping slits 24 formed therein to allow for multiple angular dispositions of the visor 12 (see FIG. 11). In this regard, the term "overlapping" refers to slits 24 which intersect a common axis. Overlapping slits 24 may enable greater degree of adjustment by the wearer. The slit 24 may additionally be curved (see FIG. 2), straight, zig-zag, waved, and the like, which is distinguishable from hinged visors, which cannot achieve their purpose with a curved slit. The slit 24 may be configured to be a gap, a cut, aperture, or any other suitable shape.

The visor body 14 may be formed from a material capable of facilitating movement of the distal portion 18 relative to the proximal portion 16. Exemplary materials include, but are not limited to, cardboard, ABS plastic, sheet metal or other suitable materials known by those skilled in the art. The visor body 14 may also be formed from a simple manufacturing process, i.e., cutting the visor body 14 from a sheet of material, and forming/cutting the slit 24 within the visor body 14. In this manner, the visor body 14 may be formed without injection molding, which tends to result in increased material, tooling, and labor costs.

While the invention has been described with reference to various and preferred embodiments, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof.

Therefore, it is intended that the invention not be limited to the particular embodiments disclosed herein contemplated for carrying out this invention, but that the invention will include all embodiments falling within the scope of the claims.

What is claimed is:

1. A headwear having a selectively adjustable visor, the headwear comprising:

a crown for covering at least a portion of a wearer's head;

a visor permanently affixed to the crown, the visor having a visor cover disposed over a unitary visor body that is non-hinged;

the non-hinged, unitary visor body having a first surface and an opposing second surface to define a uniform thickness;

wherein the non-hinged, unitary visor body is configured with at least one slit formed therein positioned away from a perimeter of the crown such that the unitary visor body is non-intersected by the at least one slit at the perimeter of the crown, the at least one slit defining a proximal portion configured to be closest to the crown such that the proximal portion is permanently affixed entirely thereto and a distal portion positioned at an opposite side of the proximal portion and configured to be away from the crown, the distal portion being transitional relative to the proximal portion between an upward position and a downward position.

2. The headwear of claim 1, wherein the visor cover is formed from at least one section of stretchable or non-stretchable material.

3. The headwear of claim 1, wherein the at least one slit is curved, straight, zig-zag, or waved.

4. The headwear of claim 1, wherein the at least one slit is a gap, a cut, or an aperture.

5. The headwear of claim 1, wherein the non-hinged, unitary visor body is fabricated of at least one of cardboard, metal, polymers, or a combination thereof.

6. The headwear of claim 1, wherein the non-hinged, unitary visor body includes a pair of connector portions where the proximal portion meets the distal portion, such that the distal portion may be integrally connected to the proximal portion by way of the connector portions.

7. The headwear of claim 1, wherein the at least one slit terminates at a first slit end and an opposing second slit end.

8. The headwear of claim 7, wherein the at least one slit may be laterally disposed while extending from a periphery of the non-hinged, unitary visor body to a middle section of the non-hinged, unitary visor body thereby forming a connector portion at the first slit end and the second slit end.

9. The headwear of claim 8, wherein the connector portion at the first slit end and the second slit end is medial to the at least one laterally disposed slit.

10. The headwear of claim 8, wherein the at least one slit and connector portion allow the distal portion to articulate relative to the proximal portion.

11. The headwear of claim 1, wherein the at least one slit may extend at least partially from the first surface toward the second surface, which may facilitate bending of the distal portion about the second surface, or from the second surface toward the first surface, which may facilitate bending of the distal portion about the first surface.

12. The headwear of claim 1, wherein the distal portion may be disposed in a planar position relative to the proximal portion such that the distal portion is substantially co-planar with the proximal portion.

13. The headwear of claim 1, wherein the visor cover may include artwork displayed adjacent the distal portion, such that when the distal portion is disposed in the upward or downward position, the artwork is readily apparent.

14. The headwear of claim 1, wherein the distal portion includes a non-intersecting distal most tip positioned at the opposite side of the proximal portion away from the crown such that the non-intersecting distal most tip is disposed down, or towards a second side of a plane defined by the proximal portion when the distal portion is disposed in the upward position.

15. The headwear of claim 14, wherein the non-intersecting distal most tip is disposed up, or towards a first side of the plane defined by the proximal portion when the distal portion is disposed in the downward position.

16. A headwear having a selectively adjustable visor, the headwear comprising:

a crown for covering at least a portion of a wearer's head;

a visor permanently affixed to the crown, the visor having a visor cover disposed over a unitary visor body that is non-hinged;

the non-hinged, unitary visor body having a first surface and an opposing second surface to define a uniform thickness;

wherein the non-hinged, unitary visor body is configured with a plurality of slits extending therearound, the plurality of slits positioned away from a perimeter of the crown such that the unitary visor body is non-intersected by the plurality of slits at the perimeter of the crown, the plurality of slits defining a proximal portion configured to be closest to the crown such that the proximal portion is permanently affixed entirely thereto and a distal portion positioned at an opposite side of the proximal portion and configured to be away from the crown, the distal portion being transitional relative to the proximal portion between an upward position and a downward position.

17. The headwear of claim 16, wherein the non-hinged, unitary visor body may include a plurality of overlapping slits formed therein to allow for multiple angular dispositions of the visor.

18. The headwear of claim 17, wherein the plurality of overlapping slits intersect a common axis.

19. The headwear of claim 16, wherein the plurality of slits are curved, straight, zig-zag, or waved.

* * * * *